US007120961B2

(12) United States Patent
Boomgaarden et al.

(10) Patent No.: US 7,120,961 B2
(45) Date of Patent: Oct. 17, 2006

(54) BRUSH WEAR ADJUSTMENT SYSTEM AND METHOD

(75) Inventors: Steven L. Boomgaarden, Rosemount, MN (US); Robert J. Erko, Apple Valley, MN (US); Michael S. Wilmo, Crystal, MN (US); Scott A. Kroll, Blaine, MN (US)

(73) Assignee: Tennant Company, Minneapolis, MN (US)

( * ) Notice: Subject to any disclaimer, the term of this patent is extended or adjusted under 35 U.S.C. 154(b) by 544 days.

(21) Appl. No.: 10/236,092

(22) Filed: Sep. 6, 2002

(65) Prior Publication Data

US 2004/0045581 A1 Mar. 11, 2004

(51) Int. Cl.
*E01H 1/05* (2006.01)

(52) U.S. Cl. ..... 15/82; 15/52.1

(58) Field of Classification Search ..... 15/21.1, 15/52.1, 82

See application file for complete search history.

(56) References Cited

U.S. PATENT DOCUMENTS

| | | | | |
|---|---|---|---|---|
| 3,008,542 | A | 11/1961 | Steele | |
| 3,604,051 | A | 9/1971 | Wendel et al. | |
| 3,639,940 | A | 2/1972 | Carlson et al. | |
| 3,756,416 | A | 9/1973 | Wood | |
| 3,792,569 | A | 2/1974 | Carlson et al. | |
| 3,881,215 | A | 5/1975 | Krier et al. | |
| 3,926,596 | A | 12/1975 | Coleman | |
| 4,017,281 | A | 4/1977 | Johnstone | |
| 4,578,840 | A | 4/1986 | Pausch | |
| 4,660,248 | A | 4/1987 | Young | |
| 4,754,521 | A | 7/1988 | Zoni | |
| 4,759,781 | A | 7/1988 | Olson | |
| 4,760,657 | A * | 8/1988 | Ganzmann et al. | 37/232 |
| 5,006,136 | A | 4/1991 | Wetter | |
| 6,192,542 | B1 | 2/2001 | Frederick et al. | |
| 6,195,836 | B1 | 3/2001 | Vanderlinden | |
| 6,195,837 | B1 | 3/2001 | Vanderlinden | |
| 6,681,433 | B1 * | 1/2004 | Ruuska et al. | 15/82 |

FOREIGN PATENT DOCUMENTS

| | | |
|---|---|---|
| DE | 1253242 | 12/1967 |
| DE | 1256241 | 12/1967 |
| EP | 0453177 | 4/1991 |
| WO | 03/069071 | 2/2003 |

* cited by examiner

*Primary Examiner*—Gladys JP Corcoran
*Assistant Examiner*—Shay L. Balsis
(74) *Attorney, Agent, or Firm*—Altera Law Group, LLC

(57) ABSTRACT

A brush wear adjustment system for use in a powered street sweeper to provide for consistent sweeping performance where wear of rotary brush bristles is constantly sensed and the rotational speed of the rotary brush is automatically increased to maintain a desired bristle tip speed to maintain desirable sweeping attributes. Rotary brush support arm angular displacement is monitored in order for an electro-hydraulic controller to influence rotational speed of the rotary brush and to provide a readout relative to bristle length.

26 Claims, 7 Drawing Sheets

BRUSH WEAR ADJUSTMENT SYSTEM AND METHOD

CROSS REFERENCES TO RELATED APPLICATIONS

None.

BACKGROUND OF THE INVENTION

1. Field of the Invention

The present invention is for a brush wear adjustment system and method, and in particular relates to a brush wear adjustment system for use in a street sweeping vehicle.

2. Description of the Prior Art

Rotary brushes utilized in street sweepers generally are mounted to the chassis of a truck or other suitable vehicle or structure. Normal wear and tear of a rotary brush during the sweeping mode results in worn rotary brush bristles the lengths of which are continually reduced due to abrasive qualities of the roadway with normal usage. The axle of the rotary brush is often secured between opposing pivot arms which gravitationally and automatically adjust in vertical fashion about pivot points to suitably contact the roadway and to compensate for the reduction in bristle length. As the bristle length is reduced, efficiency and effectiveness of the sweeping operation is increasingly degraded. Effective sweeping is predicated partially on the speed of the bristle tip, and is also predicted partially by the pressure of the bristles exerted downwardly to meet the roadway. A new rotary brush has long bristles which produces the highest bristle tip speed, and a well worn rotary brush has short bristles which produces a significantly slower and less effective bristle tip speed for the same rotary brush rate of rotation, thereby resulting in poorer and less effective sweeping. As the bristles wear, the rotary brush exhibits less control by gravitational downward force, thereby causing a lighter impingement with the roadway. Truck sweeper operators have lacked displays indicating brush wear which can be conveniently read in the control cab of a street sweeper. What is needed is a system which compensates for the degraded sweeping effectiveness and efficiency caused by continually shortening of the bristles of a rotary brush and which also displays brush wear. Such a system to provide consistent sweeping performance by increasing RPM of the rotary broom and/or adjusting the down pressure of the rotary broom is provided for by the present invention and method.

SUMMARY OF THE INVENTION

The general purpose of the present invention is to provide a brush wear adjustment system and method.

As used herein, a road sweeper is any kind of surface sweeper, including, among others, streets, roads, factory floors, and the like.

According to one embodiment of the present invention, there is provided a brush wear adjustment system and method, including a mounting surface, an optional protective enclosure, a retainer bracket, a position sensor secured to the mounting surface, a lever arm secured to and extending from the position sensor, a return spring mounted between the optional protective enclosure or other suitable location on the sweeper truck chassis and the lever arm, a linkage secured on one end to the outboard end of the lever arm and on the other end to an adjustable clevis, a linkage bracket connected to the lower end of the adjustable clevis, an electro-hydraulic controller, and a hydraulic metering valve. The hydraulic valve connects to a hydraulic rotary brush motor. Although hydraulic devices are shown and described, other devices utilizing other methods of propulsion for speed control such as, but not limited to, electric motors, rheostats, voltage controls, electronic control and the like can be utilized without departing from the apparent scope hereof.

The components of the invention are mounted to and about the chassis and other components of a sweeper truck or other such suitable vehicle or device. The position sensor and the connected lever arm are mounted to a mounting surface provided on a fixed portion of the sweeper chassis or optionally provided on an optional protective enclosure, and the linkage bracket secures to a pivoted support arm at a location between a pivot point and the corresponding rotary brush mount. The linkage attaches to and extends generally and substantially between the fixed portion of the sweeper chassis in communication with one of the pivoted support arms where displacement of the pivoted support arm is sensed by the position sensor via the interconnecting linkage. Information regarding the position of the pivoted support arm, and thus the length of the bristles, is sensed by the position sensor and sent by an interconnecting electrical cable to the electro-hydraulic controller which determines the proper and required rotary brush speed for efficient and effective sweeping by the ever shortening bristles. The position sensor also relays information to a readout display which can be located in the operating cab of the sweeper truck to indicate bristle wear. A hydraulic metering valve is actuated accordingly by the electro-hydraulic controller to increase the rotational speed of the hydraulic rotary brush motor to the required rotational speed. Aggressiveness of the sweep can be influenced by hydraulically operated cables attached to the pivoted support arms which support the rotary brush.

In another embodiment of the invention, a manual system, may be employed where sensor 16 is eliminated, and the speed controller for controlling the rotation rate of the rotary brush is provided with a manual input setting determined by a simple visual inspection of the remaining brush bristles, which may be color coded, or in the alternative a window may be provided with indicia relative to the remaining brush bristle length. In turn, this setting may be provide as an input to a controller for controlling brush rotation rate or brush position or both in accordance with a predetermined relationship to the visual inspection of the brush bristle length.

While the present invention has been particularly shown and described with reference to the accompanying figures, it will be understood, however, that other modifications thereto are of course possible, all of which are intended to be within the true spirit and scope of the present invention. Various changes in form and detail may be made therein without departing from the true spirit and scope of the invention as defined by the appended claims.

More specifically, position sensor 16 is intended to provide an output signal indicative of remaining brush bristle length on the brush. Brush diameter or radius is, of course, related to brush bristle length. Likewise, brush weight is indicative of bristle length since as the bristles wear, the brush weight decreases. Thus, sensor 16 represents any type of sensor which may provide an output signal indicative of the quantity intended to be sensed, i.e., bristle length, for ultimately controlling either the rotation rate of the rotary brush and/or the pressure of the brush against the surface intended to be swept in order to achieve consistent sweeping performance of a road sweeper or the like. Accordingly, sensor 16 may be implemented by a wide array of sensors including proximity sensors, optical sensors, and weight sensors depending upon the selected control scheme in accordance with the principles of the present invention, all of which are intended to be within the spirit and scope of the present invention.

Further, the most simplest form of the present invention is an open loop control system for setting the rotation rate of the rotary brush or brush position or both in response to the sensed value of the remaining bristles on the rotary brush. However, a closed loop control system may also be employed having more or less advantages. Further, the control system of the present invention may be complex employing an algorithmic relation of bristle length to the controlled parameter, i.e., brush rotation rate or position, or may simply be based on a selected or predetermined look up table relating the parameter intended to be controlled in response to the sensed value of the remaining bristles on the rotary brush, all of which are intended to be within the spirit and scope of the present invention. It should also be recognized that the brush wear system of the present invention may be implemented by a wide array of analog and digital techniques, including microprocessors, computers, software and firmware, and the like, and either being part of a sole system or part of a more complex controller having many more functions.

Although depicted in the drawings is a particular rotary brush positioning system employing linkages, cables, hydraulic pumps, electro-hydraulic controllers, and hydraulic motors, and the like, others are of course possible. For example, the rotary brush system may be implement by electrical linear actuators or linear hydraulic actuators as opposed to pivotal arrangements shown in the drawings, and the like, all of which are intended to be within the true spirit and scope of the present invention.

A significant aspect and feature of the present invention is a brush wear adjustment system which provides for consistent sweeping performance by adjustment of rotary brush speed and/or rotary brush down pressure.

A significant aspect and feature of the present invention is a brush wear adjustment system which accommodates the constant and increasing shortening of bristles.

Another significant aspect and feature of the present invention is a brush wear adjustment system which senses data relating to the rotating brush bristle length.

Another significant aspect and feature of the present invention is a brush wear adjustment system which increases the rotational rate of a rotating brush to maintain the tip speed of a bristle.

Yet another significant aspect and feature of the present invention is a brush wear adjustment system incorporating the use of a position sensor to determine vertical displacement of a rotary brush.

A further significant aspect and feature of the present invention is a brush wear adjustment system incorporating the use of an electro-hydraulic controller to determine required rotary brush speed.

A still further significant aspect and feature of the present invention is a brush wear adjustment system incorporating a metering valve controlled by an electro-hydraulic controller to vary the rotary brush speed.

Yet another significant aspect and feature of the present invention is the use of the invention as a brush wear indicator where the wear or the amount of bristle remaining can be viewed on a swivelable readout display in the operator cab of a sweeper truck.

Having thus described embodiments of the present invention and enumerated several significant aspects and features thereof, it is the principal object of the present invention to provide a brush wear adjustment system, and method for use in a road sweeper or other suitable device.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
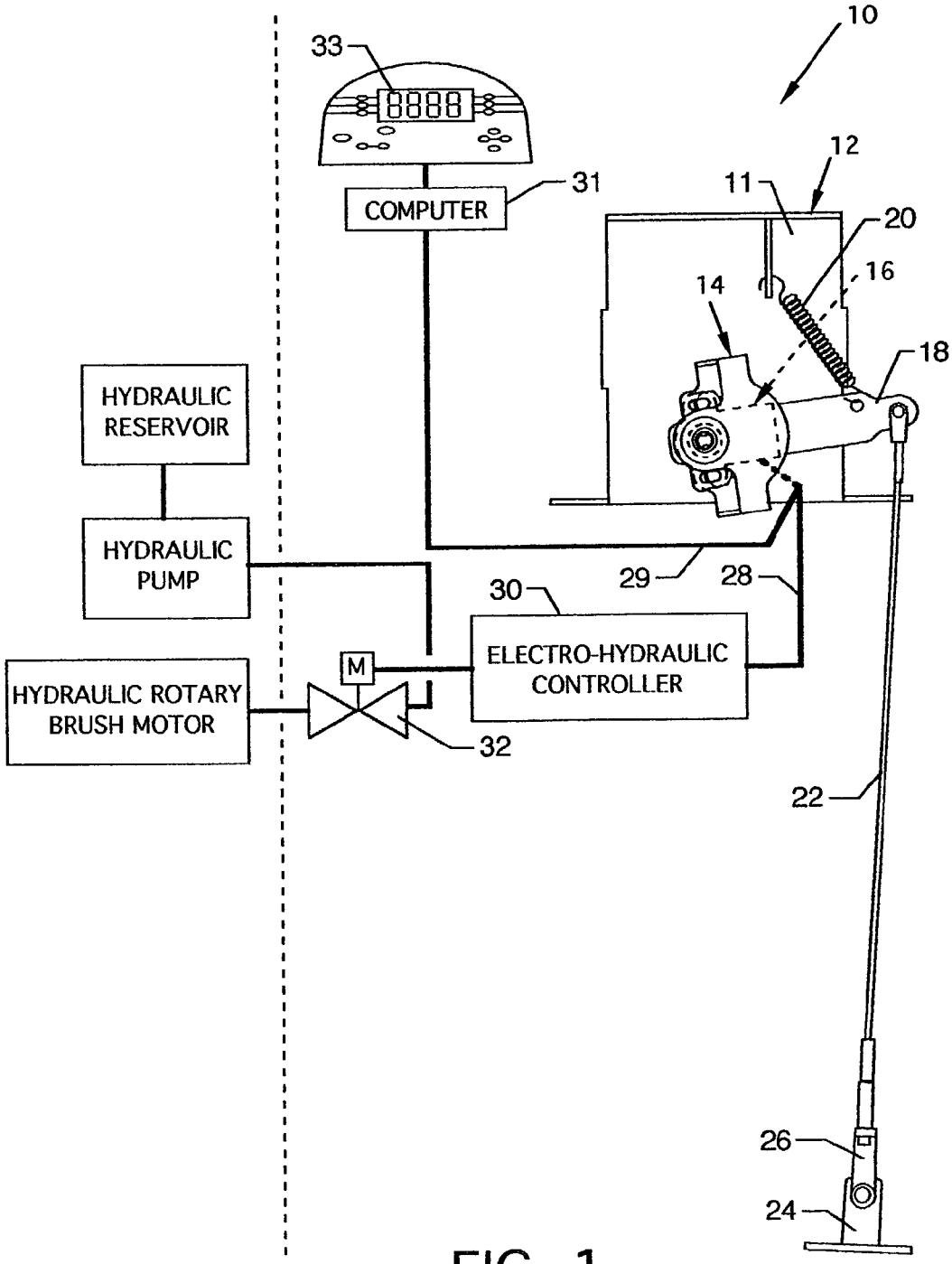
FIG. 1 illustrates a brush wear adjustment system, the present invention, connected to components external to the invention.

FIG. 1 illustrates a brush wear adjustment system 10, the present invention, connected to components external to the invention the external components of which include a hydraulic reservoir and a hydraulic rotary brush motor, and a hydraulic pump. The invention mounts, in part, to a mounting surface 11 which can be almost any suitably located stable and planar surface of varying size, such as a nearby truck chassis member. The typically utilized mounting surface 11 could also be a separate planar structure, such as shown herein, and could also include an optional protective enclosure 12, if desired. The mounting surface 11 serves as a direct or indirect mount for components including a retainer bracket 14, a position sensor 16, a lever arm 18, and a return spring 20. One end of a linkage 22 connects to the outwardly located end of the lever arm 18 and the other end of the linkage 22 communicatively connects to a linkage bracket 24 via an adjustable clevis 26. The linkage 22 can be a rod, a chain, a cable or other suitable device which can connect the outwardly located end of the lever arm 18 to the linkage bracket 24 via the adjustable clevis 26. An electrical cable 28 connects electrically between the position sensor 16 and an electro-hydraulic controller 30 to relay electrical positional information relating to the angular displacement of the lever arm 18 from a datum as measured by the position sensor 16. Such electrical positional information is incorporated to control the speed of the rotary brush 76 and to provide information for a brush length readout display 33.

Electrical positional information is sent via the electrical cable 28 to the electro-hydraulic controller 30 which contains suitable circuitry or computational devices such as, but not limited to, a micro-computer, as well as other required controlling devices. The output of the electro-hydraulic controller 30 controls a metering valve 32 or other such suitable apparatus which under commands can variably deliver hydraulic fluid from a hydraulic reservoir and hydraulic pump under the correct pressure and suitable flow to the hydraulic rotary brush motor of a sweeper. In the alternative and in lieu of the metering valve 32, the electro-hydraulic controller 30 could control a variable displacement hydraulic pump to power the hydraulic rotary brush motor; or, the electro-hydraulic controller 30 could directly control a variable speed rotary brush motor.

Electrical positional information as provided by the position sensor 16 is sent via an electrical cable 29 to a computer 31 which drives the readout display 33 to provide bristle length information to either the driver or driver's assistant in the truck sweeper cab. The readout display 33 can be swivel mounted for viewing by the driver or driver's assistant.

Figure 2:
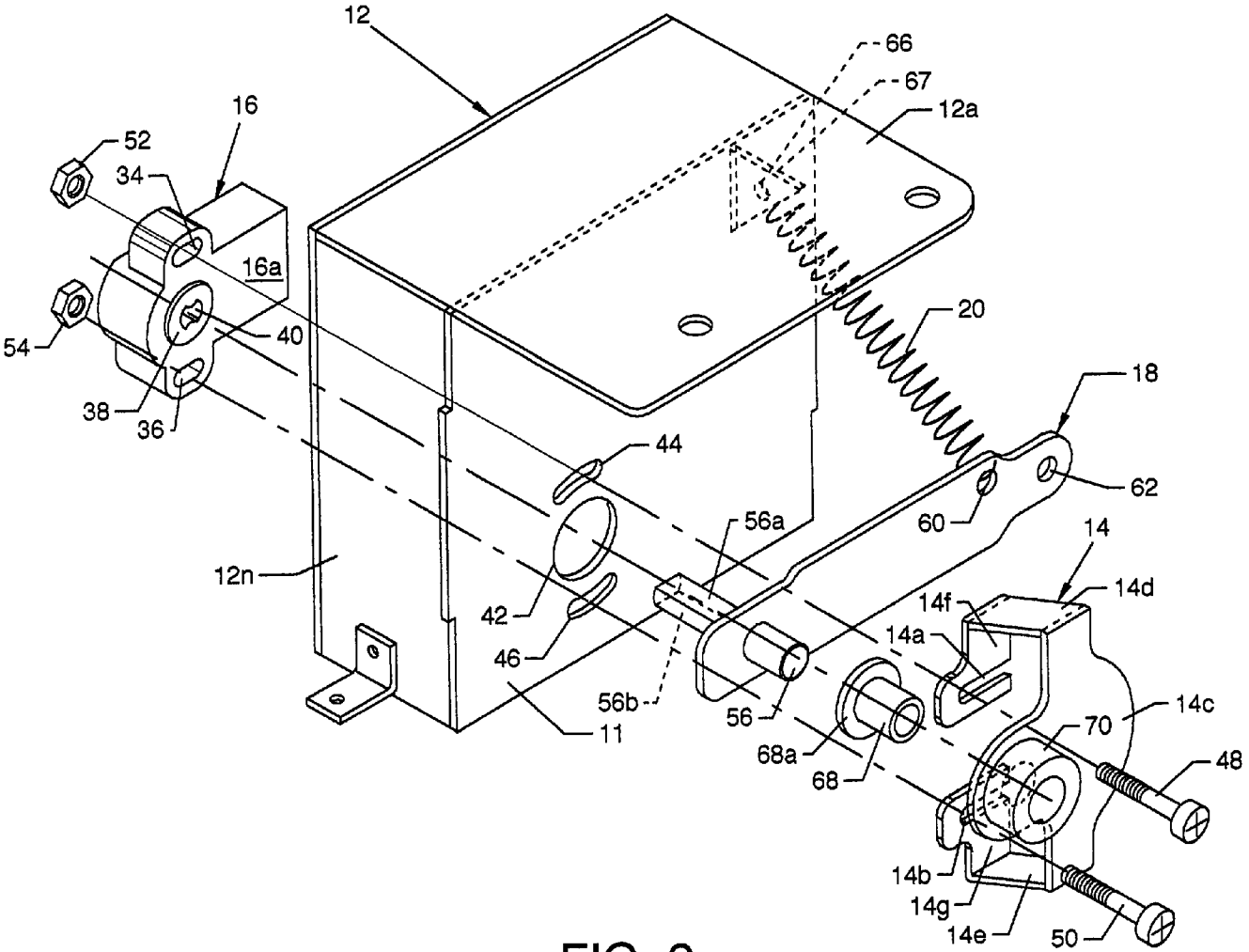
FIG. 2 illustrates an exploded view of the components of the invention mounted to a mounting surface.

FIG. 2 illustrates an exploded view of the components of the invention mounted to a mounting surface 11. The optional protective enclosure 12 having a plurality of planar sides 12*a*–12*n* can mount to one side of the mounting surface 11. The mounting surface 11 is conveniently shown as a member which could be sized for mating with the optional protective enclosure 12, but could be any suitable road sweeper panel or structure member extending beyond the optional protective enclosure. The position sensor 16 includes horizontally oriented mounting slots 34 and 36 centered about a rotationally positionable shaft 38 having a receptor slot 40. The rotationally positionable shaft 38 extends slightly beyond the inwardly located planar surface 16*a* of the position sensor 16. The position sensor 16 mounts to the back side of the mounting surface 11 and is mounted thereto where the extended end of the rotationally positionable shaft 38 accommodatingly aligns with a body hole 42 on the mounting surface 11. Opposing arcuate slots 44 and 46 center about the body hole 42, as well as aligning respectively with the mounting slots 34 and 36 of the position sensor 16. Machine screws 48 and 50 extend through arcuate slots 44 and 46 and the mounting slots 34 and 36, as well as slots 14*a* and 14*b* of the retainer bracket 14, to engage lock nuts 52 and 54. The entire position sensor 16 can be rotated about the rotationally positionable shaft 38 and be positionally rotated to the extent allowed by the relationship of the machine screws 48 and 50 engaging the arcuate slots 44 and 46 and the mounting slots 34 and 36. Such rotational positioning allows for operational calibration of the brush wear system 10. The lever arm 18 includes a shaft 56 fixedly extending through one end. The inwardly positioned end of the shaft 56 includes opposing flattened surfaces 56*a* and 56*b* to allow accommodation by the receptor slot 40 of the rotationally positionable shaft 38. The opposing end of the lever arm 18 includes a spring engagement hole 60 and a cable connector engagement hole 62. The return spring 20 connects between the lever arm spring engagement hole 60 and an anchoring hole 66 located on or near the mounting surface 11. For purposes of example and demonstration, the anchoring hole 66 is shown on a bracket 67. A bearing 68 is accommodated by and fits over the outwardly facing portion of the shaft 56 to serve as an interface between the shaft 56 and a bearing mount 70 located on the retainer bracket 14. The retainer bracket 14 includes an outwardly located panel 14*c* upon which the bearing mount 70 is located, upper and lower offset panels 14*d* and 14*e* extending offsettingly at an angle from the upper and lower portions of the outwardly located panel 14*c*, and inwardly located slot panels 14*f* and 14*g*, including slots 14*a* and 14*b*, extending vertically downwardly and upwardly from the offset panels 14*d* and 14*e*, respectively. Offsetting the slots 14*a* and 14*b* allows free and clear access of the machine screws 48 and 50 to the arcuate slots 44 and 46 and the mounting slots 34 and 36 previously described.

Figure 3:
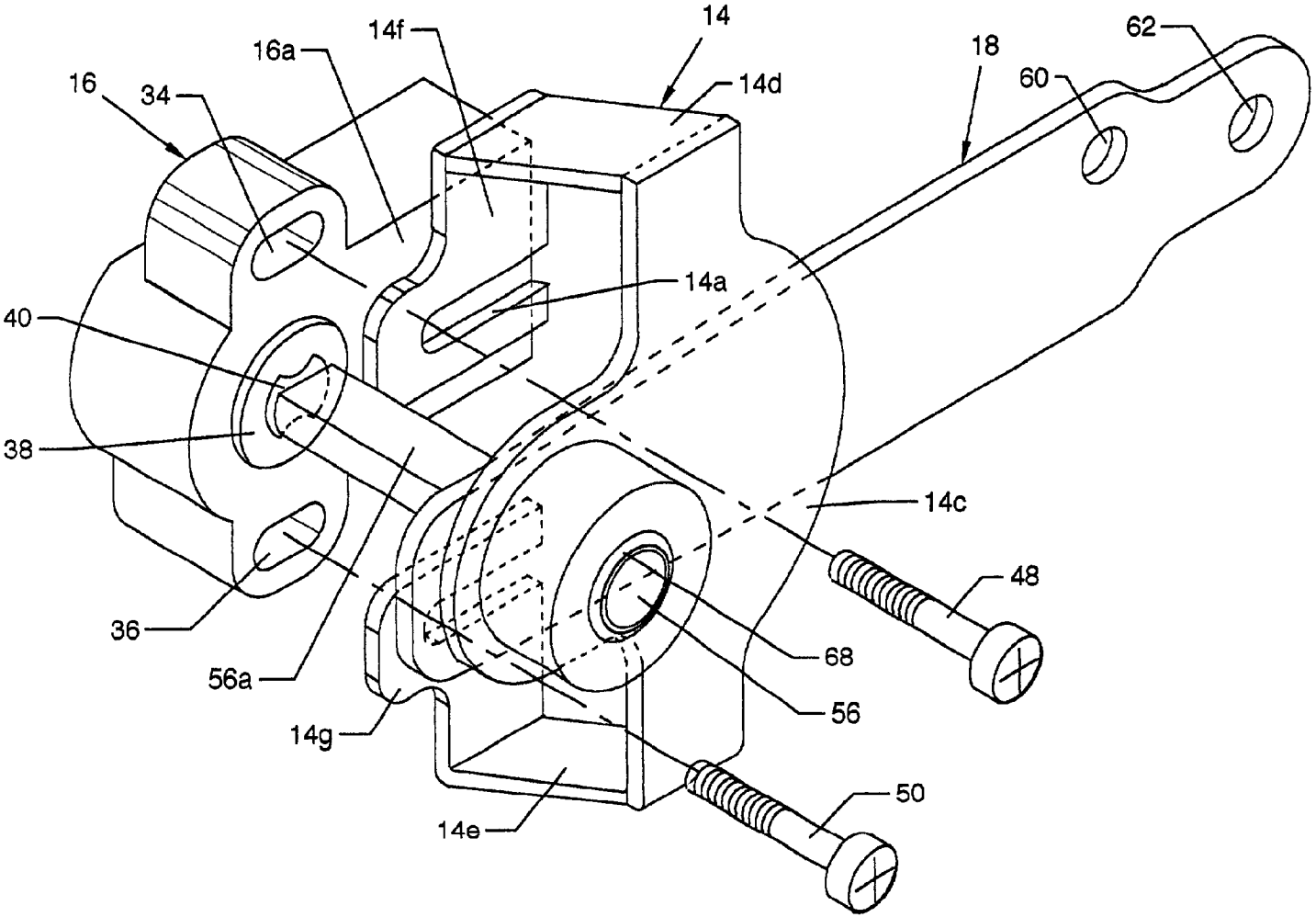
FIG. 3 illustrates an isometric view of the combined retainer bracket, bearing and lever arm in distanced alignment with the position sensor.

FIG. 3 is an isometric view of the combined retainer bracket 14, bearing 68 and lever arm 18 in distanced alignment with the position sensor 16. Shown in particular is the relationship of the lever arm 18 in close juxtaposition with the outwardly located panel 14*c* and being distanced therefrom, as shown in FIG. 5, by the planar portion 68*a* of the bearing 68 disposed therebetween.

Figure 4:
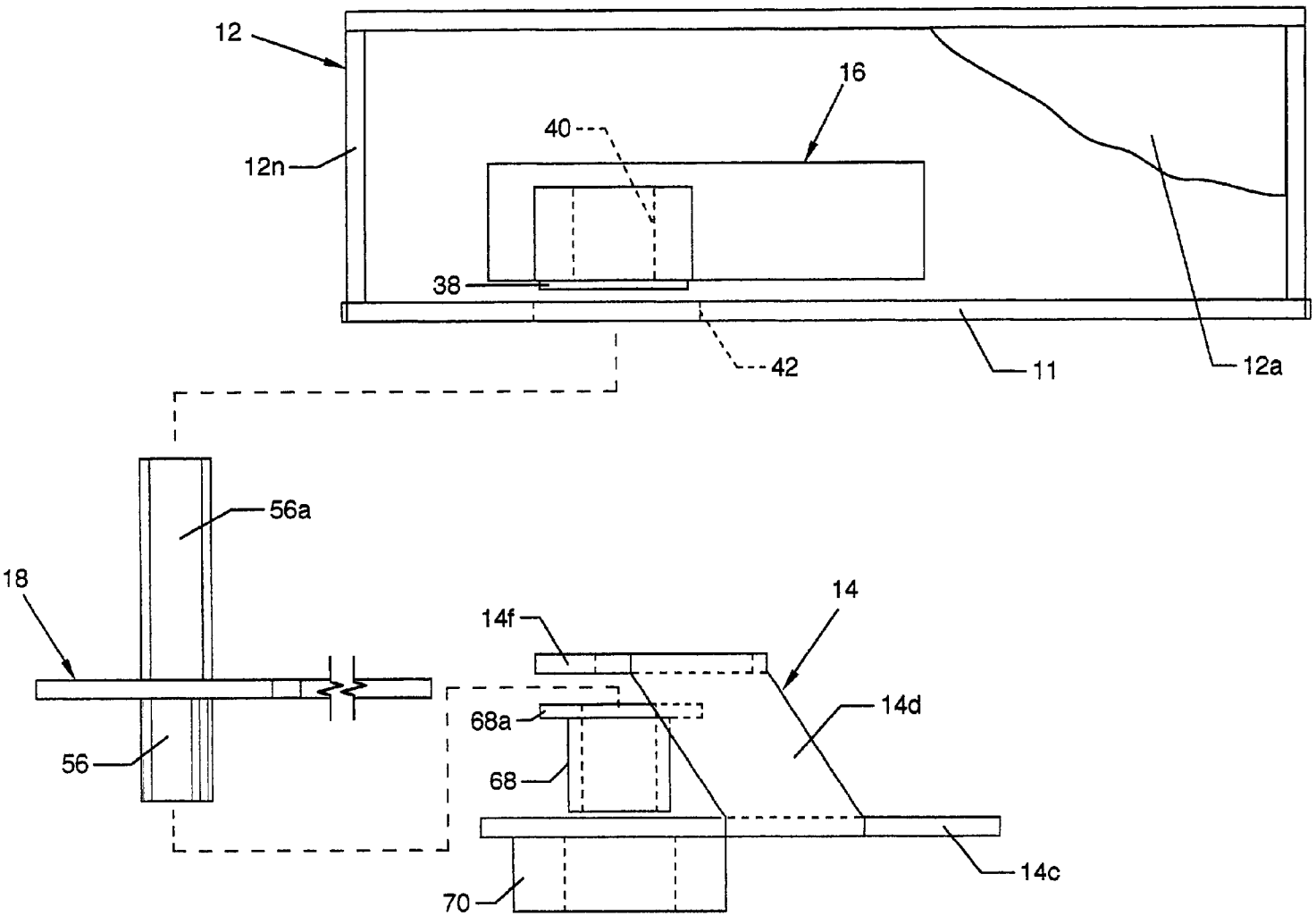
FIG. 4 illustrates an exploded top view in partial cutaway of the relationship of the mounting surface, the optional protective enclosure, the position sensor, the retainer bracket, the bearing and the lever arm.

FIG. 4 is an exploded top view in partial cutaway of the relationship of the mounting surface 11, the optional protective enclosure 12, the position sensor 16, the retainer bracket 14, the bearing 68 and the lever arm 18.

Figure 5:
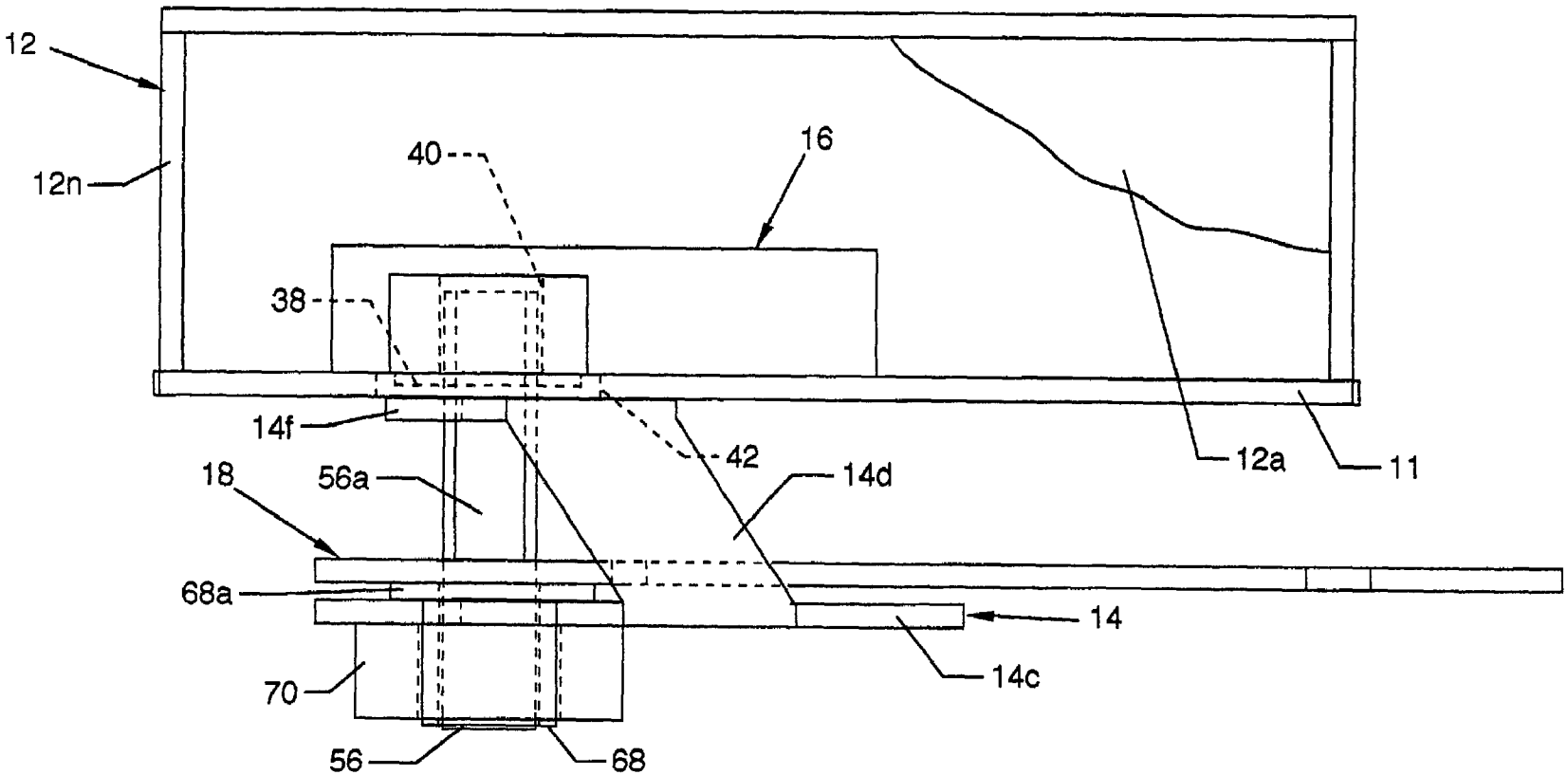
FIG. 5 illustrates a top view in partial cutaway of the relationship of the mounting surface, the optional protective enclosure, the position sensor, the retainer bracket, the bearing and the lever arm.

FIG. 5 is a top view in partial cutaway of the relationship of the mounting surface 11, the optional protective enclosure 12, the position sensor 16, the retainer bracket 14, the bearing 68 and the lever arm 18.

Mode of Operation

Figure 6:
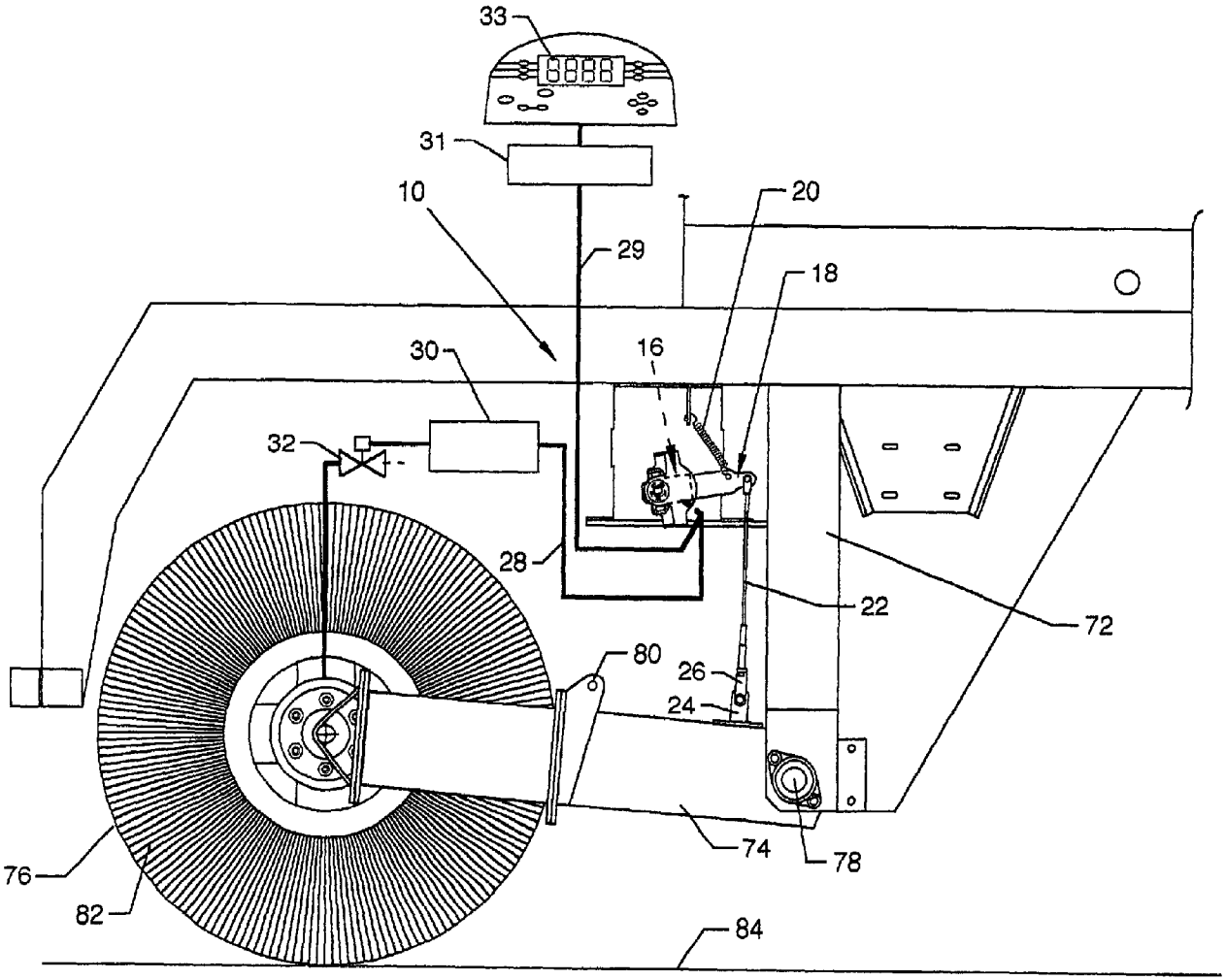
FIG. 6 illustrates in part the mode of operation of the invention in use where the brush wear adjustment system is incorporated into use with and mounted to a chassis and to a pivoted rotary brush support arm of a street sweeper; and, FIG. 7 illustrates in part the mode of operation of the invention in use where the brush wear adjustment system is incorporated into use with and mounted to a chassis and to a pivoted rotary brush support arm of a street sweeper.
Figure 7:
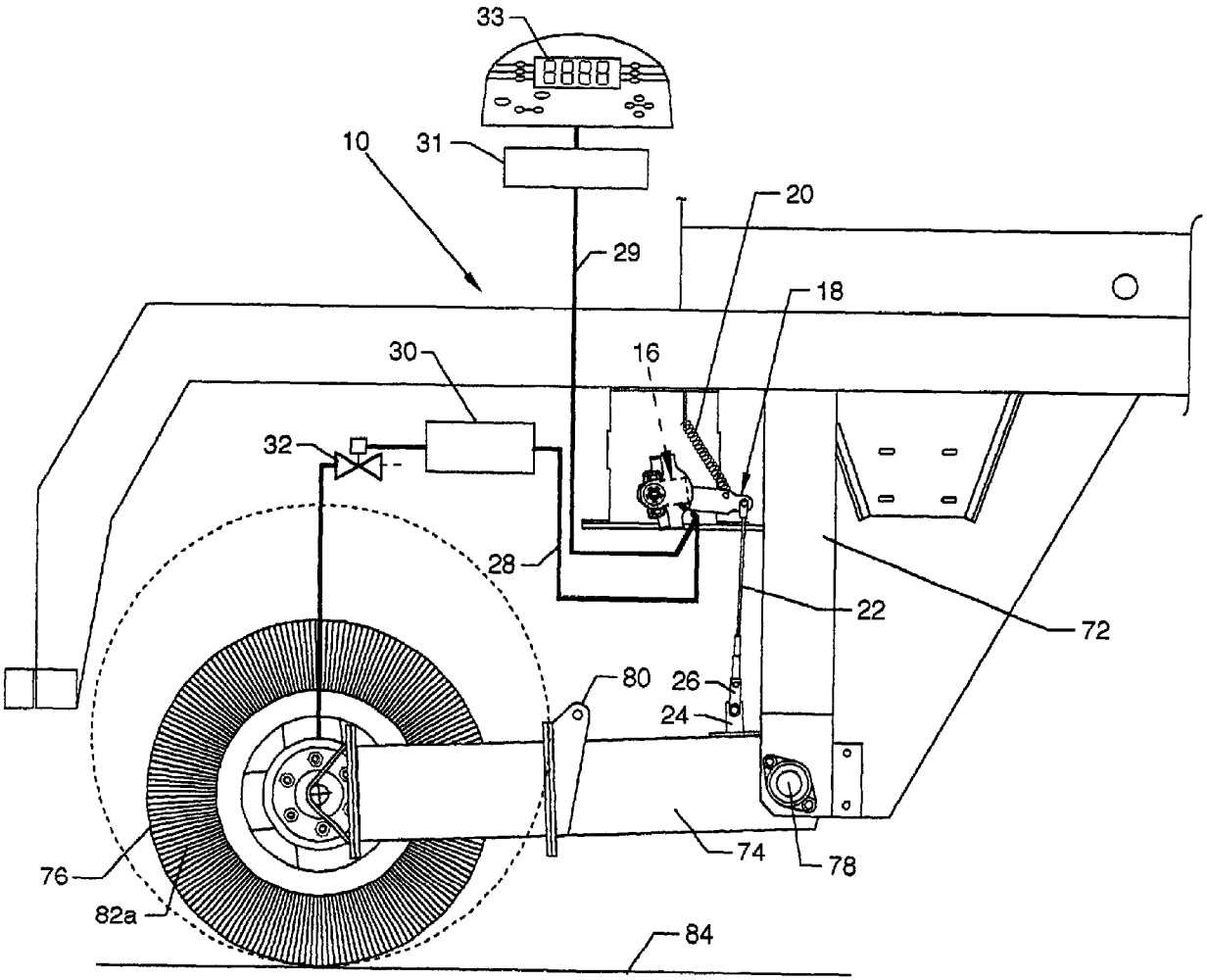

FIGS. 6 and 7 illustrate the mode of operation of the invention in use where the brush wear adjustment system 10 is incorporated into use with and mounted to a chassis 72 and to a pivoted rotary brush support arm 74 of a street sweeper, where the rotary brush is in contact with a roadway 84. A powered rotary brush 76 attaches to the rearward end of the pivoted rotary brush support arm 74 and to the rearward end of a corresponding similarly constructed and configured opposing pivoted rotary brush support arm (not shown), but referred to as pivoted rotary brush support arm 74*a*. The powered rotary brush 76 and pivoted support arm 74 are supported by a pivot 78 and by a bracket 80 which is variably supported by a hydraulically operated positioning cable (not shown). Typically, positioning cables are attached to a torque tube which is influenced by a hydraulic cylinder to provide supportive lift for the pivoted rotary brush support arms 74 and 74*a* and the corresponding pivoted rotary brush support arm and for the rotary brush 76 to share the loading of the bristles 82. Such an arrangement influences the amount of pressure applied between the bristles 82 of the rotary brush 76 and the roadway 84. The aggressiveness, i.e., the amount of rotary brush down pressure of the sweep can be determined by the operator. The amount of pivoted rotary brush support arm and rotary brush support provided can be controlled by the operator to apply the correct amount of down pressure required for an individual sweeping job. Light debris, such as dust or dry leaves, would require light bristle pressure where a greater portion of the pivoted rotary brush support arm weight and rotary brush weight is provided by the hydraulically operated positioning cables where other heavier debris, such as wet leaves, dirt, small stones, gravel or the like, require heavy bristle pressure to achieve suitable sweeping where a lesser portion of the pivoted rotary brush support arm weight and rotary brush weight is provided by the hydraulically operated positioning cables. The linkage 22 at the end of the lever arm 18 connects to the pivoted support arm 74 to monitor the angular displacement of the pivoted support arm 74 where such displacement is determined by the length of the bristles 82.

FIG. 6 depicts a rotary brush 76 having full length bristles 82 yet unaffected by roadway abrasion and wear encountered during normal sweeping along the roadway 84. Commencing with sweeping operations with bristles 82 being of full length, the pivoted support arm 74 is positioned as shown where the pivoted rotary brush support arm 74 is at or near the upwardmost angle of travel with respect to the full length of the bristles 82. Accordingly, the lever arm 18 of the brush wear adjustment system 10 is positioned at or near the upwardmost angle of lever arm 18 travel and preferably the linkage 22 is tensioned slightly against the force of the return spring 20 to provide an accurate and responsive datum information for positional processing by the electro-hydraulic controller 30. The appropriate and lower relative rotational speed of the rotary brush 76 having full length bristles 82 as sensed by the position sensor 16 and attached lever arm 18 is determined by the electro-hydraulic controller 30. Such determination requires that the metering valve 32 or other such suitable device causes the hydraulic pressure from a hydraulic reservoir and hydraulic pump to be regulated or otherwise controlled to provide the proper and suitable rotational speed of the rotary brush 76.

FIG. 7 depicts a rotary brush 76 having shortened bristles, herein designated as shortened bristles 82*a*, affected by roadway abrasion and wear encountered during normal and continued sweeping along the roadway 84. During sweeping operations with the worn and shortened bristles 82*a*, the pivoted support arm 74 being angularly displaced is positioned as shown where the pivoted rotary brush support arm 74 is at or near the lowermost angle of travel with respect to the shortened length of the bristles 82*a*. Accordingly, the lever arm 18 of the brush wear adjustment system 10 is also positioned at or near the lowermost angle of lever arm 18 travel. Information regarding the shortened length bristles 82*a* of the rotary brush 76 as sensed by the position sensor 16 and attached lever arm 18 is delivered to the electro-hydraulic controller 30 and an appropriate rotary brush 76 speed is determined. Such determination requires that the metering valve 32 or other such suitable device causes the hydraulic pressure from a hydraulic reservoir and hydraulic pump to be accommodatingly regulated to provide the proper and increased and suitable rotational speed of the rotary brush 76. Such increasing of the rotary brush 76 rotational speed and of the attached shortened bristles 82*a* increases the tip speed of the shortened bristles 82*a* to compensate for the degraded sweeping effectiveness and efficiency caused by continually shortening of the bristles 82 of the rotary brush 76 to promote consistent sweeping performances. During the sweeping operation and as the bristles 82 decrease in length, the speed of the rotary brush 76 is automatically increased at a suitable rate as sensed by the position sensor 16 which is rotated by angular displacement of the lever arm 18. Positional information from the position indicator 16 is incorporated by the electro-hydraulic controller 30 at all times to produce a suitable rotary brush 76 rotational rate.

Various modifications can be made to the present invention without departing from the apparent scope hereof.

Brush Wear Adjustment System and Method

Parts List

| | |
|---|---|
| 10 | brush wear adjustment system |
| 11 | mounting surface |
| 12 | optional protective enclosure |

-continued

| | |
|---|---|
| 12a–n | planar sides |
| 14 | retainer bracket |
| 14a–b | slots |
| 14c | outwardly located panel |
| 14d–e | offset panels |
| 14f–g | slot panels |
| 16 | position sensor |
| 16a | planar surface |
| 18 | lever arm |
| 20 | return spring |
| 22 | linkage |
| 24 | linkage bracket |
| 26 | adjustable clevis |
| 28 | electrical cable |
| 29 | electrical cable |
| 30 | electro-hydraulic controller |
| 31 | computer |
| 32 | metering valve |
| 33 | readout display |
| 34 | mounting slot |
| 36 | mounting slot |
| 38 | rotationally positionable shaft |
| 40 | receptor slot |
| 42 | body hole |
| 44 | arcuate slot |
| 46 | arcuate slot |
| 48 | machine screw |
| 50 | machine screw |
| 52 | lock nut |
| 54 | lock nut |
| 56 | shaft |
| 56a–b | flattened surfaces |
| 60 | spring engagement hole |
| 62 | cable connector engagement hole |
| 66 | anchoring hole |
| 67 | bracket |
| 68 | bearing |
| 68a | planar portion |
| 70 | bearing mount |
| 72 | chassis |
| 74 | pivoted support arm |
| 76 | rotary brush |
| 78 | pivot |
| 80 | bracket |
| 82 | bristles |
| 82a | shortened bristles |
| 84 | roadway |

The invention claimed is:

1. A self compensating brush wear adjustment system for a rotary brush on a street sweeper configured to maintain a predetermined sweeping efficiency regardless of brush wear, wherein the axle of the rotary brush is carried by opposing pivoted support arms, the brush wear adjustment system comprising:

a. a mounting surface located on the street sweeper;

b. a lever arm rotatably mounted to the mounting surface;

c. a return element urging the lever arm to a starting position;

d. a linkage connecting the lever arm to at least one of said pivoted support arm carrying the rotary brush;

e. a position sensor responsive to said lever arm, configured to determine the diameter of the brush;

f a controller configured to receive a signal from the position sensor and to control the rotational speed of a motor mechanism to regulate the rotation rate of the rotary brush to maintain the cleaning efficiency of the rotation speed of the brush by maintaining the brush's tip speed as the diameter of the brush decreases.

2. The brush wear adjustment system of claim 1, wherein the rotary brush has a gravitationally controlled lower position, responsive to remaining bristle length, and includes an adjustable clevis is set to cause the system to detect the wear of the rotary brush by detecting the change in gravitationally controlled lower position and to increase the rotation rate of the rotary brush to maintain a desired sweeping speed of bristle ends against a road surface.

3. The system of claim 1 further including a signal processor instructing the controller to adjust the rotational speed in accordance with a look-up table based on information from the position sensor indicative of brush diameter for setting the rotational speed of the brush to maintain brush tip velocity.

4. A self compensating brush tip velocity maintenance system for a motor driven rotary brush on a street sweeper, wherein the axle of the rotary brush is carried by opposing pivoted support arms, the brush wear adjustment system comprising:

a. a mounting surface located on the street sweeper;

b. a lever arm rotatably mounted to the mounting surface;

c. a return mechanism urging the lever arm to a starting position;

d. a linkage connecting the lever arm to at least one said pivoted support arm carrying the rotary brush and including an adjustable clevis;

e. a position sensor; responsive to said lever arm and, f. a motor controller receiving a signal from the position sensor and adjusting the motor to maintain a constant tip velocity on the brush as its diameter decreases with wear.

5. The brush wear adjustment system of claim 4, wherein the rotary brush has a gravitationally controlled lower position, responsive to remaining bristle length, and includes an adjustable clevis set to cause the system to lift the rotary brush a desired height above the gravitationally controlled lower position, thereby reducing pressure on the rotary brush.

6. The system of claim 4 further including a signal processor instructing the controller to adjust the rotational speed in accordance with a look-up table based on information from the position sensor indicative of brush diameter for setting the rotational speed of the brush to maintain brush tip velocity.

7. A self compensating brush wear adjustment system for a rotary brush on a street sweeper driven by a motor, wherein the axle of the rotary brush having substantially radial bristles is carried by opposing pivoted support arms, the brush wear adjustment system comprising:

a. a sensor for indirectly measuring bristle length being indicative of brush wear;

b. a linkage connecting the sensor to the rotary brush; and, c. a controller receiving a signal from the sensor and directing the motor to maintain a predetermined sweeping force between the rotary brush and a road surface despite changes in bristle length due to brush wear.

8. The system of claim 7 further including a signal processor instructing the controller to adjust the rotational speed in accordance with a look-up table based on information from the sensor indicative of brush diameter for setting the rotational speed of the brush to maintain brush tip velocity.

9. A self compensating brush wear adjustment system for a rotary brush on a street sweeper wherein the brush bristle length, decreases with wear, the brush wear system comprising:

a. a brush sensor for providing a brush size signal indicative of remaining brush bristle length on the brush; and b. controller for receiving a signal from the sensor and a drive means for rotating the brush, the controller increases the rotation rate of the rotary brush in response to decreasing bristle length to compensate for a decrease in bristle tip velocity to maintain consistent sweeping performance.

10. The brush wear adjustment system of claim 9, wherein the controller and drive means includes a signal control means for rotating the rotary brush in accordance with a selected speed versus brush size signal relationship.

11. The brush wear adjustment system of claim 9, wherein the brush sensor includes means for detecting substantially the radius diameter of the rotary sweeper brush and the brush size signal is indicative of thereof.

12. The brush wear adjustment system of claim 9, further comprising a visual readout responsive to the brush size signal for providing a visual display indicative thereof.

13. The brush wear adjustment system of claim 9, wherein the brush sensor is responsive to the weight of the rotary brush.

14. The brush wear adjustment system of claim 9, wherein the controller and drive means includes a signal control means for rotating the rotary brush in accordance with a predetermined speed versus bristle-length characteristic so as to rotate the rotary brush at a desired sweeping speed of bristle ends against a road surface.

15. The brush wear adjustment system of claim 9, wherein the controller and drive means includes a signal control means for rotating the rotary brush in accordance with a predetermined function of rotary brush weight loss and brush bristle length so as to maintain a desired sweeping force as the rotary brush is progressively reduced in weight and reduction in brush bristle length due to brush wear.

16. The brush wear adjustment system of claim 9, wherein the controller and drive means includes a signal processor for rotating the rotary brush in accordance with a look-up table for setting the rotation rate of the brush in relation to the brush size signal.

17. The brush wear adjustment system of claim 9, further comprising rotary brush positioning means for controlling the force or pressure of the brush bristles against the surface intended to be swept in response to the brush size signal.

18. The system of claim 9 further including a signal processor means for instructing the drive mean to adjust the rotational rate in accordance with a look-up table based on information from the brush sensor indicative of brush diameter for setting the rotational speed of the brush to maintain brush bristle tip velocity.

19. A self compensating brush wear adjustment system for a rotary brush on a street sweeper wherein the brush bristle length, decreases with wear, the brush wear system comprising:

a. a brush sensor for providing a brush size signal indicative of remaining brush bristle length on the brush;

b. a look up table correlating bristle length to optimum rotational velocity of the brush; and c. rotary brush positioning and controlling means configured to receive data from said look up table in response to the brush size signal for controlling the force or pressure of the brush bristles against the surface intended to be swept so as to achieve consistent sweeping performance.

20. The brush wear adjustment system of claim 19, wherein the rotary brush positioning and controlling means includes a signal control means for adjusting the position of rotary brush in accordance with a selected position versus brush size signal relationship.

21. The brush wear adjustment system of claim 19, wherein the brush sensor includes means for detecting substantially the radius or diameter of the rotary sweeper brush and the brush size signal is indicative thereof.

22. The brush wear adjustment system of claim 19, further comprising a visual readout responsive to the brush size signal for providing a visual display indicative thereof.

23. The brush wear adjustment system of claim 19, wherein the brush sensor is responsive to the weight of the rotary brush.

24. The brush wear adjustment system of claim 19, wherein the rotary brush positioning and controlling means includes a signal control means for positioning the rotary brush in accordance with a selected position versus bristle-length relationship.

25. The brush wear adjustment system of claim 19, wherein the rotary brush positioning and controlling means includes a signal control means for positioning the rotary brush in accordance with a predetermined function of rotary brush bristle length so as to maintain a desired sweeping force as the rotary brush is progressively reduced in weight and reduction in brush bristle length due to brush wear.

26. The brush wear adjustment system of claim 19, wherein the rotary brush positioning and controlling means includes a signal processor for positioning the rotary brush in accordance with a look-up table for setting the position of the brush in relation to the brush size signal.

* * * * *